US006342855B1

(12) United States Patent
Rothe

(10) Patent No.: US 6,342,855 B1
(45) Date of Patent: Jan. 29, 2002

(54) MOBILE RADIOTELEPHONY PLANAR ANTENNA

(76) Inventor: Lutz Rothe, Am Muhlberg 43, D-06132 Halle (DE)

( * ) Notice: Subject to any disclaimer, the term of this patent is extended or adjusted under 35 U.S.C. 154(b) by 0 days.

(21) Appl. No.: 09/269,248

(22) PCT Filed: Sep. 17, 1997

(86) PCT No.: PCT/EP97/05094

§ 371 Date: Jan. 10, 2000

§ 102(e) Date: Jan. 10, 2000

(87) PCT Pub. No.: WO98/13896

PCT Pub. Date: Apr. 2, 1998

(30) Foreign Application Priority Data

| | | |
|---|---|---|
| Sep. 23, 1996 | (DE) | 196 38 874 |
| Feb. 19, 1997 | (DE) | 197 06 571 |
| Feb. 20, 1997 | (DE) | 197 06 913 |

(51) Int. Cl.[7] ..... H01Q 1/38
(52) U.S. Cl. ..... 343/700 MS
(58) Field of Search ..... 343/700 MS, 846, 343/829, 830; H01Q 1/36, 1/38

(56) References Cited

U.S. PATENT DOCUMENTS

| | | | | |
|---|---|---|---|---|
| 4,160,976 A | * | 7/1979 | Conroy | 343/700 MS |
| 5,023,621 A | | 6/1991 | Ushiyama et al. | 343/702 |
| 5,041,838 A | | 8/1991 | Liimatalnen | 343/700 MS |

FOREIGN PATENT DOCUMENTS

| | | |
|---|---|---|
| EP | 0 516 303 A1 | 5/1992 |
| EP | 0 651 458 A1 | 10/1994 |

* cited by examiner

*Primary Examiner*—Michael C. Wimer
(74) *Attorney, Agent, or Firm*—Woodbridge & Associates, P.C.; Richard C. Woodbridge

(57) ABSTRACT

The invention relates to a planar antenna (1), in particular for mobile radio, the planar antenna (1) having two conductive layers arranged at a predefined distance from one another, the conductive layers being plates (2, 12, 20, 20'; 3, 13, 30, 30') or sheets which are plane-parallel with one another, the first layer (2, 12, 20, 20') having a surface that is symmetrical with respect to a symmetry axis (15) and the second layer (3, 13, 30, 30') being a subregion of the surface of the first layer, the second layer being formed by reducing, or respectively cutting off or leaving out a part of the first area along a straight line or chord (4, 14, 40, 40') extending at right angles to the symmetry axis (15), and the chord of the second layer forming a rectilinear edge, and the two layers being conductively connected to one another, the conductive connection being made by pointwise-arranged or strip-like connection elements (15, 19) on the border (8, 18) of the layers which is remote from the chord (4, 14, 40, 40').

16 Claims, 6 Drawing Sheets

MOBILE RADIOTELEPHONY PLANAR ANTENNA

BACKGROUND OF THE INVENTION

1. Field of the Invention

The invention relates to a planar antenna, in particular for mobile radio, the planar antenna having two conductive layers arranged at a predefined distance from one another.

2. Background of the Invention

The application area of the invention relates primarily to the mobile radio field and, in this case, in particular to E and D networks.

Known antenna solutions for the field of mobile radio applications are based on linear antenna designs in the form of monopole arrangements in shortened or unshortened embodiments. These linear antennas are known both as externally mountable onboard antennas and components directly coupled to the terminal, and are subject to different directionality and efficiency, these components being exclusively omnidirectional in the azimuthal plane. Known patch antenna solutions are based on dipole-like configurations which are arranged in two-dimensional fashion and whose directional diagrams is irregular and, in connection with the respective background, exhibit the features of significant radiation field deformation. The radiation properties relating to the application field are significantly inferior to those of conventional linear antennas. Likewise, controlled masking properties of the radiation diagram are not demonstrable. No further solutions are known whose electromagnetic or radiation properties are obtained on the basis of asymmetric and open waveguide technology, in particular microstrip technology, with the use of self-supporting conductive sheet conductors or sheet-like conductor surfaces.

EP 0 176 311 discloses a planar antenna which has a ground plane which is kept at a distance from the radiator element by means of a dielectric substrate layer. The radiator element is fed by means of a coaxial waveguide and is electrically conductively connected by means of short-circuit connections on one side to the ground surface. The radiator element is a geometrical subregion of the ground plane. EP 0 176 311 also discloses a two-dimensional short-circuit connection between the ground plane and the radiator element.

DE 195 04 577 discloses a mobile radio antenna for motor vehicles, which also has a radiation element that is in connection with the inner conductor of a coaxial waveguide. One side of the radiator element is in conductive connection with a ground surface via a short-circuit connection.

SUMMARY OF THE INVENTION

The object of the present invention is to provide a two-dimensional radiator component with the property that it can produce linearly polarized and spatially wide sector radiation both in the azimuthal and in the elevation plane, as well as pronounced back-radiation attenuation and therefore useful radiation exclusively within a space hemisphere preferably in the spectral ranges of between 890 MHz and 960 MHz or 1710 MHz and 1890 MHz.

This object is achieved by the invention according to the distinguishing part of claim 1. Through the conductive connections of the two layers, a reduction in the overall size by approximately a factor of 2 is obtained, since $\lambda/2$ waves can advantageously be received. By virtue of the fact that the distance between the rectilinear edge and the short-circuited border changes, it is possible to receive and transmit in a relatively broad spectral range. In this case, it is advantageous if the first layer is circular and the second layer is reduced compared with the first by a chord portion, the chord portion forming a rectilinear edge. In this case, the conductive connections on the border side remote from the rectilinear edge may be produced by means of connection elements in point form or strip form. It may, however, also be advantageous to configure the base surface first layer elliptically, in a triangular shape, square or hexagonally.

The oscillation conditions of the planar radiator can advantageously be implemented by simulation software to investigate field problems of radio frequency radiation. In this regard, it should be noted that, for each spectral range, a comprehensive set of different oscillation conditions need to be taken into consideration depending on the radiator characteristic. Since full calculation taking these boundary conditions into account is not possible, the person skilled in the art is inevitably led to simulation trials if he wants to configure the planar radiator according to the invention to his circumstances.

The oscillation conditions of the planar radiator can also advantageously be influenced using diaphragms produced in the second layer by holes in the conductive layer. In this regard, the diaphragms form implemented capacitors with distributed parameters, which in this form electrically extend the waveguide geometry or provide the possibility of geometrical miniaturization. The arrangement of the diaphragms is in this selected symmetrically, since the symmetry condition represents the prerequisite for preserving the preferential polarization of the electric field vector. In this case, by means of the diaphragm position, the possibility is provided of altering the oscillation direction of the field vectors, which are primarily affected by the diaphragms, and therefore the resultant field profiles which are created by superposition. The location where the diaphragms are introduced and, subordinately, the diaphragm contour determine the degree to which the conduction currents, as well as the associated electric and magnetic field components, are affected. To that extent, the position and contour of the diaphragms primarily dictate the raising or lowering of the capacitive and inductive components within the reactive component budget. Since the diaphragms which are introduced basically influence the complex waveguide properties, besides alteration of the spectral oscillation conditions, the possibility is thereby provided of affecting the spectral bandwidth of the type of oscillation excited. The surface of each diaphragm may in this case either be circular, elliptical, rectangular, square, triangular, hexagonal or irregular. The optimum shape of the diaphragms and their arrangement can in turn usually be established only empirically by simulation tests. The electromagnetically resonating oscillation arrangement is excited or fed by means of a coaxial waveguide, the inner conductor of the waveguide being conductively connected to the second layer and the outer conductor of the waveguide being conductively connected to the first layer, the inner conductor being arranged through a diaphragm within the first layer, axially symmetric to the diaphragm border and without electrical connection to the latter.

The way in which the two layers are in connection with one another along border remote from the rectilinear edge is freely selectable. It is thus possible to connect these two layers to one another by means of conductive pins. This is advantageous especially when no dielectric is arranged between the two layers, and the two layers are formed, for example, by copper plates. The conductive connection pins are then used, as it were, as spacers.

If a dielectric is arranged between the two layers, it may be used as a support for the two conductive layers, the conductive connection then being advantageously made outside the dielectric, to which end the dielectric may be coated in linear or two-dimensional form on its outer edge.

The shape of the border on which the two layers are conductively connected to one another, is in principle freely selectable, although care must be taken to comply with the oscillation conditions. If the border remote from the rectilinear edge or chord extends parallel to the chord, only a monochromatic frequency response can be obtained. It is therefore necessary to design this border edge non-parallel to the rectilinear edge or chord of the second layer if a frequency spectrum or band is desired.

The planar radiator according to the invention forms an optimum antenna component or replacement component for the external vehicle antenna with the possibility of being mounted inside the passenger compartment. The application field further relates to general indoor applications, in that the radiator component forms a component spatially remote from the terminal in question and can be mounted on the inside and in two-dimensional fashion on the relevent room glazing. It is also possible for the room glazing itself to serve as the dielectric support of the conducting two layers.

The radiator component or planar antenna according to the invention can advantageously be used in all cases in which the space lying behind the antenna aperture is to be kept free of radiation or at a low radiation level, and the exposure of the user to electromagnetic radiation is therefore to be minimized.

Further, the radiator component according to the invention forms a base module for short or medium range transmission systems for communication, sensor or safety applications.

BRIEF DESCRIPTION OF THE DRAWINGS

The planar antenna according to the invention will be explained in more detail below with reference to Figures, in which.

DETAILED DESCRIPTION OF THE PREFERRED EMBODIMENT

Figure 1:
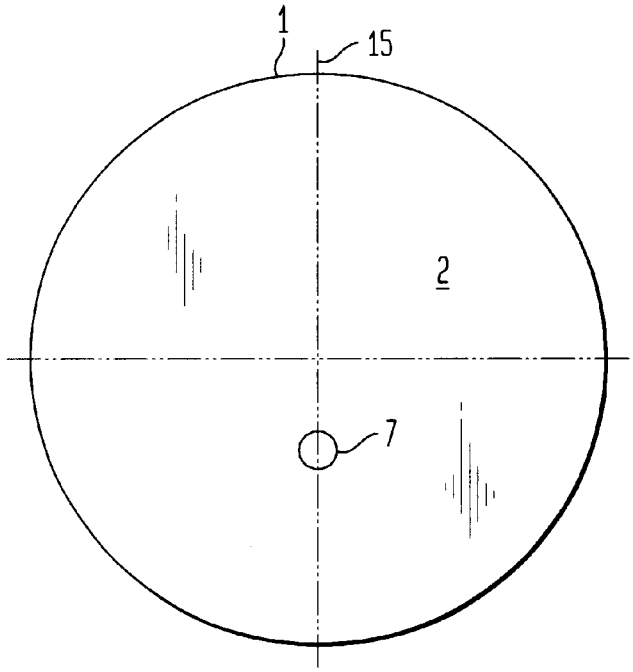
FIG. 1 shows a plan view of a first layer.

FIG. 1 shows a low-loss low dielectric structure support, preferably polypenco Q 200.5, polycarbonate or polystyrene, with a diameter of 93 mm. and a base height of 5 mm, which on one side has a continuous conductive layer 2, preferably consisting of copper or aluminum with a layer thickness of between 5 $\mu$m and 800 $\mu$m. The conductive layer is preferably produced by means of additive or substractive techniques.

There is a conductive layer 3 on the side of the structural support remote from the continuous conductive layer 2. This layer 3 is a segment of a circle, which is reduced by a chord portion in comparison with the first layer 2, the chord 4 being arranged at right angles to the symmetry axis of the layers 2, 3. On the outer edge or boundary edge 8 opposite the rectilinear boundary edge or chord 4 of the conductive layer 3, the two conducting layers 2 and 3 are conductively connected to one another over the length L1, the half-length L1/2 counting of the respectively starts at the line which is perpendicular to the rectilinear boundary edge 4, or at the symmetry axis 15. The planar radiator is fed by means of a coaxial waveguide, the outer conductor of the waveguide (not shown) being in connection with the conducting layer 2 in the region of the diaphragm 7, and the inner conductor of the waveguide (not shown) being fed through the diaphragm 7 to the connection point 6 of the second layer 3. The characteristic impedance of the waveguide is preferably 50 ohms. The electromagnetic diaphragm 7 is formed through a circular opening in the conductive layer 2 having a diameter of 3.2 times the inner conductor diameter of the coaxial waveguide. The length of the perpendicular 20 changes continuously in the region L1, with the result that a defined spectral range can be received or transmitted.

Figure 3:
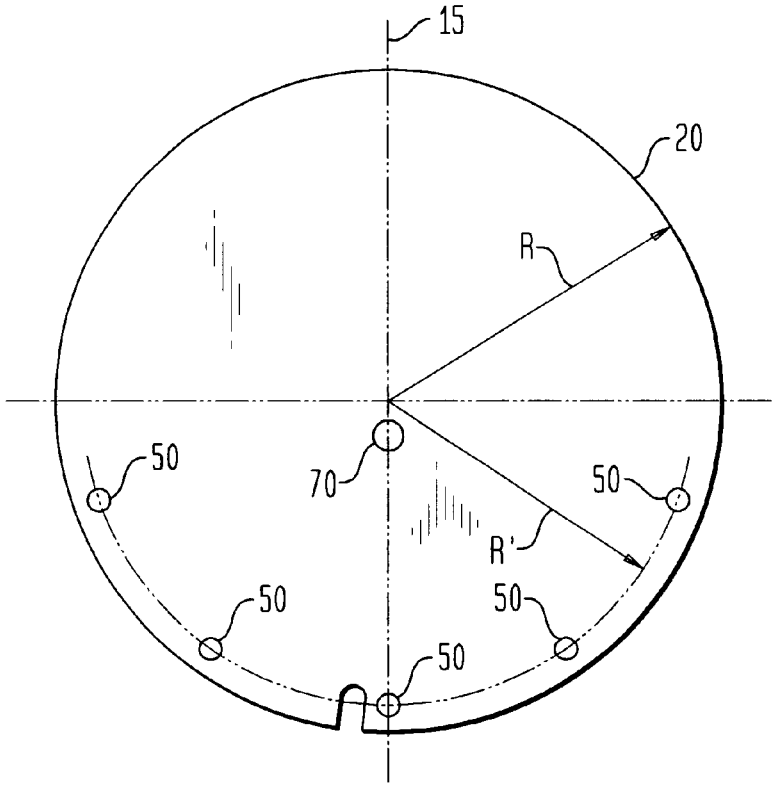
FIG. 3 shows a plan view of another embodiment of a planar antenna according to the invention with point-like conducting connections.
Figure 4:
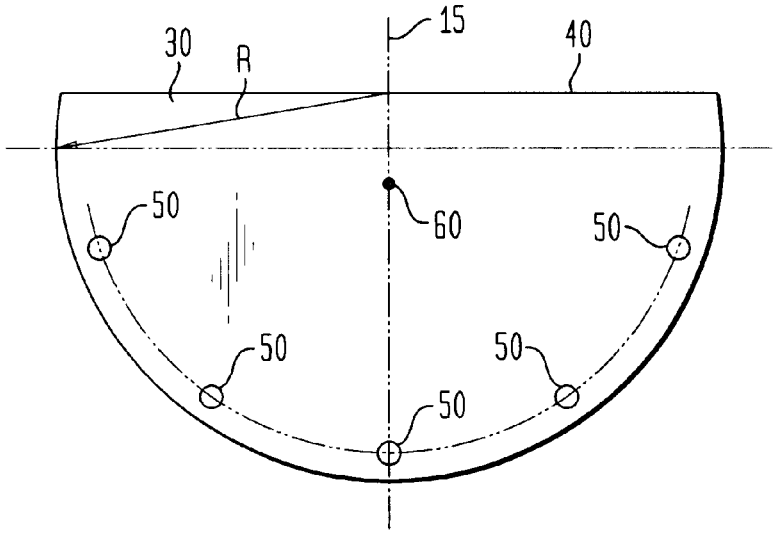
FIG. 4 shows a plan view of the second layer associated with the first layer according to FIG. 3.
Figure 5:
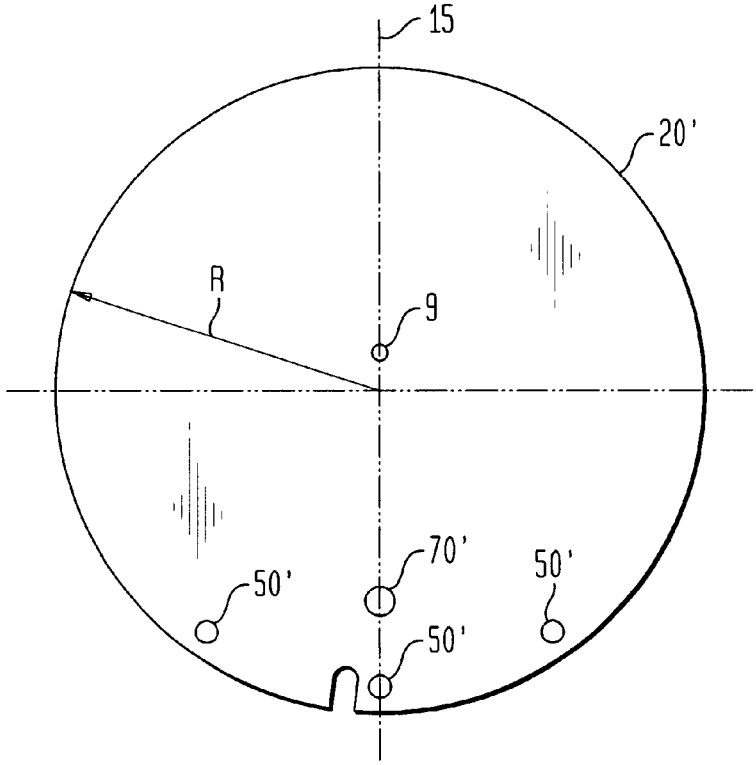
FIGS. 5, 6 show another illustrative embodiment of a planar antenna according to the invention with circular hole in the second layer.
Figure 6:
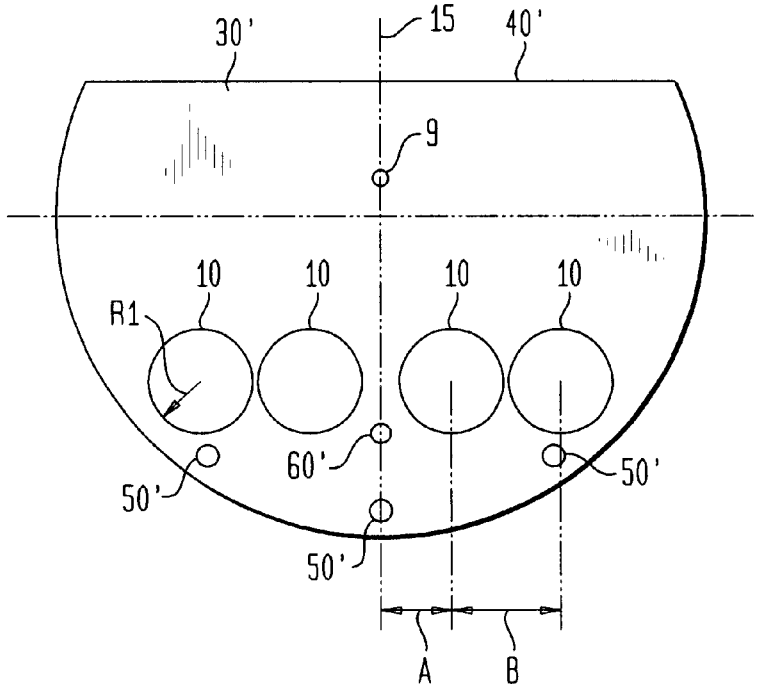
Figure 7:
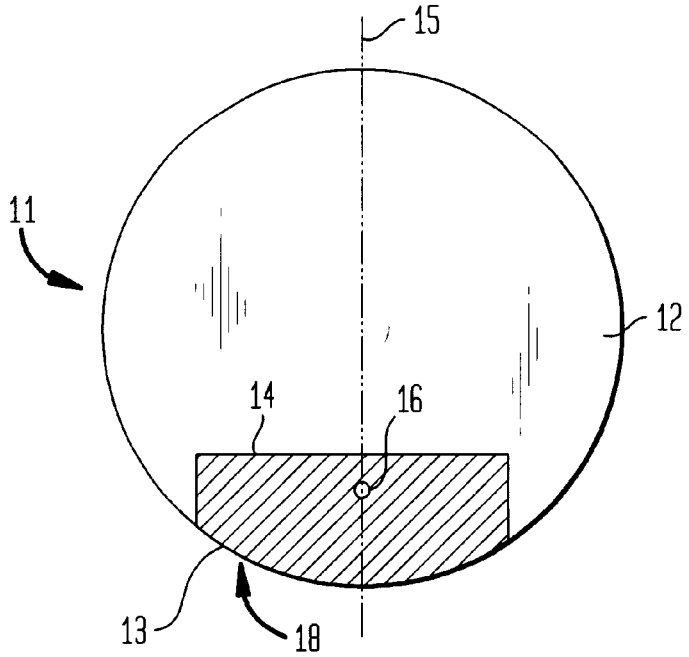
FIGS. 7–9 show a planar radiator with a circular dielectric and conductive coatings applied to the latter.
Figure 8:
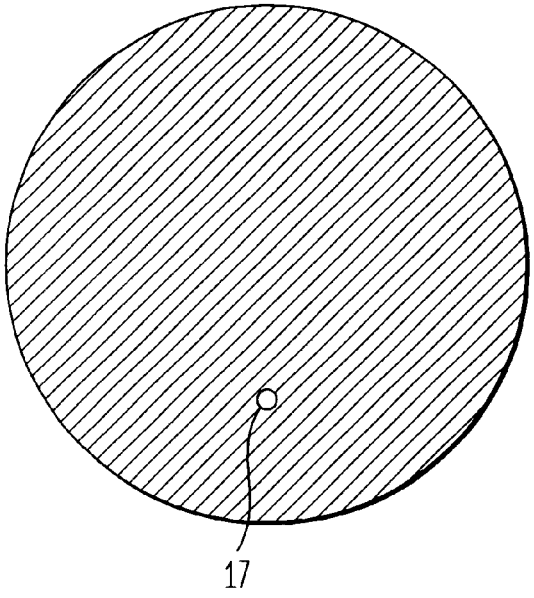
Figure 9:
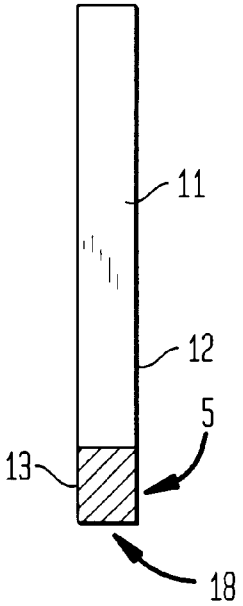

FIGS. 3 and 4 show an illustrative embodiment of a planar antenna for the frequency range between 1710 MHz and 1890 MHz. According to FIG. 3, a conductive metal plate 20 with circular border and diameter 90 mm is coupled plane-parallel over a distance of 4.8 mm to a second conductive metal plate 30, which is designed as a portion of a circle, the centers both of the full-circle surface and of the circle portion surface are arranged on an identical symmetry axis 15 and, according to FIG. 4, the conductive plate 30 is conductively coupled to the conductive plate 20 at five points 50, one of the five points 50 being positioned or the arrangement's symmetry line 76 extending in the plane of the circle portion surface, by fitting conductive connection elements 5 according to FIG. 11 at the position marked in FIG. 3 between the conductive plate 20 and the conductive plate 30. The inner conductor of the coupling coaxial waveguide is electrically coupled with the conductive plate 30 at point 60. In this case, the inner conductor is taken by means of a dielectric bush, preferably a PTFE bush, centrally between the conductive plates 20 and 30 through the hole 70 within the conductive plate 20. The PTFE bush is in this case designed as a cylindrical sleeve with a length of 4.8 +/−0.1 mm, whose external diameter measures 1.4–0.1 mm and whose internal diameter measures 1.4 mm over a length of 3.8–0.1 mm and with an internal diameter of 2.2 mm over a length of 1 mm. The outer conductor of the signal-coupling coaxial waveguide is coupled in the immediate vicinity of the hole 70 with the conductive plate 20 arranged plane-parallel with the plate 30. Another embodiment of the invention for a planar antenna for the frequency range between 890 MHz and 960 MHz is shown by FIGS. 5 and 6. According to FIG. 1, a conductive metal plate 20' with circular border and diameter 90 mm is coupled plane-parallel over a distance of 4.8 mm to a second conductive metal plate 30', which is designed as a portion of a circle, the centers both of the full-circle surface and of the circle portion surface are arranged on an identical axis and, according to FIG. 6, the conductive plate 30' is provided with four circular hole 10 in a line extending parallel to the chord and is conductively coupled to the conductive plate 20' at three points 50', one of the three points 50' being positioned on the arrangement's symmetry line extending in the plane of the circle portion surface, by fitting conductive connection elements 5 according to FIG. 11 at the position marked in FIG. 5 between the conductive plate 20' and the conductive plate 30' . To provide mechanical stabilization, a support cylinder 9 according to FIG. 10 with a diameter of 6 mm, which is positioned on the symmetry line of the arrangement is inserted between the conductive plate 20' and the conductive plate 30'. The inner conductor of the coupling coaxial waveguide is electrically coupled with the conductive plate 30' at point 60'. In this case, the inner conductor is taken by means of a dielectric bush, preferably a PTFE bush, centrally between the conductive plates 20' and 30' through the hole 70' within the conductive plate 20'. The PFTE bush is in this case designed as a cylindrical sleeve with a length of 4.8 +/−0.1 mm, whose external diameter measures 1.4–0.1 mm and whose internal diameter measures 1.4 mm over a length of 3.8–0.1 mm and with an internal diameter of 2.2 mm over a length of 1 mm. The outer conductor of the signal-coupling coaxial waveguide is coupled in the immediate vicinity of the hole 70' with the conductive plate 20' arranged plane-parallel with the plate 38'. Another illustrative embodiment is shown by FIGS. 7 to 9. According to FIGS. 7 to 9, on one side of a low-loss and low-dielectric structural support 11, preferably polypenco Q 200.5, polycarbonate or polystyrene, with a diameter of 93 mm and a base height of 5 mm, a continuous conductive layer 12, preferably consisting of copper or aluminum with a layer thickness of between 5 $\mu$m and 800 $\mu$m, is produced by means of additive or subtractive techniques, preferably substractive techniques.

On the opposite side of the dielectric support 11 from the continuous and conductive surface 12, according to FIG. 8, a surface segment 13 with a conductive layer, preferably consisting of copper or aluminum with a layer thickness of between 5 $\mu$m and 80 $\mu$m, is placed, the conductive layer 13 that is produced being conductively connected to the continuous conductive surface 12 on the outer edge 18 of the conductive surface segment 13 opposite the rectilinear boundary edge 14 of the conductive layer. Feeding is carried out by means of contact with a coaxial waveguide, in that, at point 16 according to FIG. 8, the inner conductor of the coaxial waveguide, with a characteristic impedance of preferably 50 ohms, is conductively connected to the surface segment 13, and the outer conductor of the coaxial waveguide is connected to the opposite continuous and conductive layer 12 with a full-circle surface, the inner conductor of the coaxial waveguide being fed through an electromagnetic diaphragm 17 in the form of a circular opening within the conductive layer 12 having a diameter of 3.2 times the inner conductor layer of the coaxial waveguide.

Figure 10:
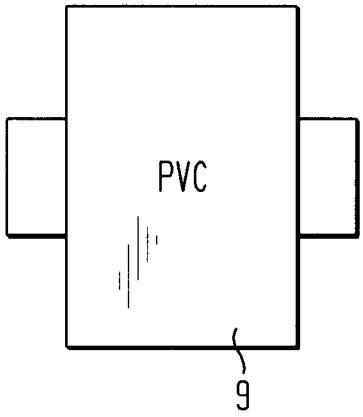
FIG. 10 shows a spacer or support cylinder.
Figure 11:
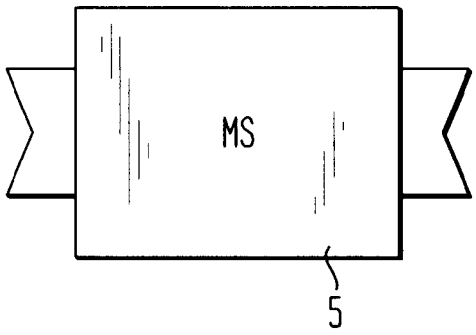
FIG. 11 shows a point-like connection element.
Figure 12:
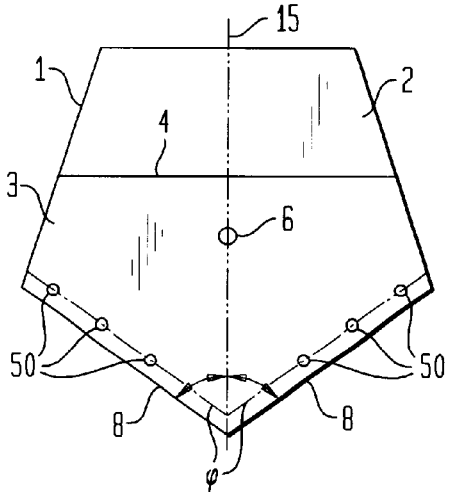
FIGS. 12–15 show plan views of various embodiments of planar radiators.
Figure 13:
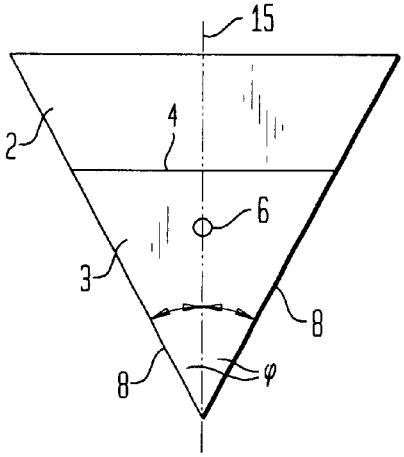
Figure 14:
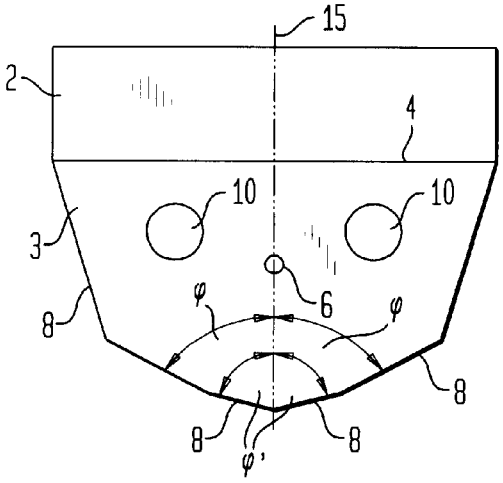
Figure 15:
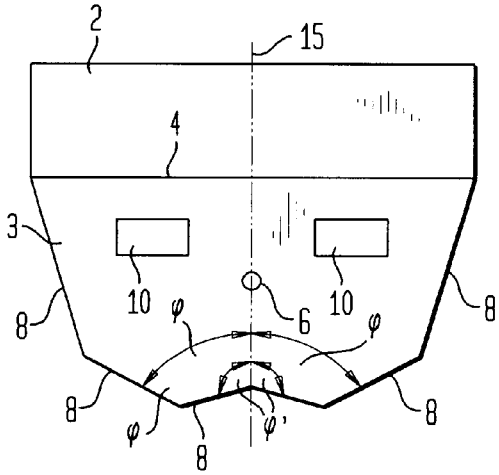

FIG. 10 shows a support cylinder 9 made of a nonconducting material. FIG. 11 represents an electrically conducting connection element for connecting the points 50, 50' according to FIGS. 3 to 6. FIGS. 12 to 15 show various possible embodiments or border shapes of the planar antenna according to the invention, the nature of the frequency response, as well as of frequency range, being adjustable through special selection of the angle $\phi$ or $\phi'$ in FIGS. 14 and 15. Thus, FIG. 12 shows that, at an angle $\phi$ of between 0 and 90 degrees of angle in the case of a polygon, the borders 8 may be conductively in connection with one another by means of point-like connection elements at points 50. FIGS. 14 and 15 show that the number and shape of the electromagnetic diaphragms 10 is likewise freely selectable.

Figure 2:
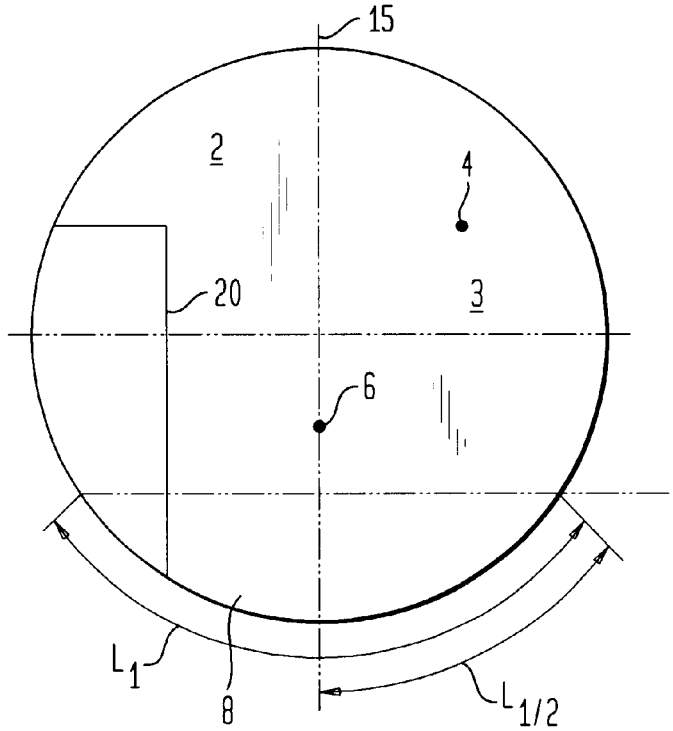
FIG. 2 shows a plan view of the second layer of the planar radiator with the underlying first layer (FIG. 1), the first and second layers being conductively connected to one another over a length L1.
Figure 16:
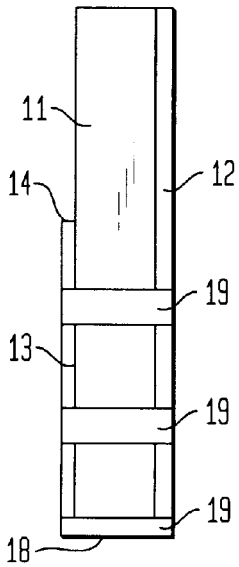
FIG. 16 and FIG. 17 side views of planar radiators with electrically conducting connection elements applied to the outer edge of the dielectric.
Figure 17:
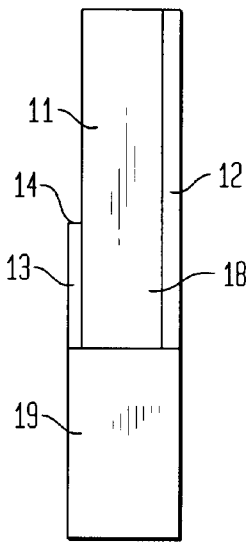

FIGS. 16 and 17 respectively show a side view of the planar antenna according to the invention, the lateral edge of the dielectric support material L having strip-like connection elements 19 applied to it, so that at these locations the two conductive layers 12 and 13 are in connection with one another. FIG. 17 shows a side view of the planar antenna explained according to FIGS. 1 and 2, the two conducting layers 12 and 13 being in connection over a length L1 via the conductive connection element 19.

What is claimed is:

1. A planar antenna, in particular for mobile radio, the planar antenna (1) having two conductive layers arranged at a predefined distance from one another and the conductive layers being plates (2, 12, 20, 20'; 3, 13, 30, 30'), the first layer (2, 12, 20, 20') having a surface that is symmetrical with respect to a symmetry axis (15) and the second layer (3, 13, 30, 30') whose shape comprises a portion of the shape of the first layer, the second layer being formed by taking an area of identical dimensions as the first layer and removing a section along a straight line (4, 14, 40, 40') extending at right angles to the symmetry axis (15), and the line of the second layer forming a rectilinear edge, and the two layers being conductively connected to one another, the conductive connection being made by point or strip connection elements (5, 19) on the border (8, 18) of the layers, wherein the first layer (2, 12, 20, 20') and the second layer (3, 13, 30, 30') are designed with a circular border, and the circular borders of the two layers are congruent, the second layer being reduced compared with the area of the first layer by a chord portion, the chord corresponding to the line (4, 14, 40, 40').

2. A planar antenna (1) as claimed in claim 1, wherein diaphragms (10) are arranged parallel to the line (4, 14, 40, 40'), the diaphragms (10) being formed by holes in the second layer.

3. A planar antenna (1), in particular for mobile radio, the planar antenna (1) having two conductive layers arranged at a predefined distance from one another, the first layer (2, 12, 20, 20') having a surface that is symmetrical with respect to a symmetry axis (15) and the second layer (3, 13, 30, 30') whose shape comprises a portion of the shape of the first layer, the second layer being formed by taking an area of identical dimensions as the first layer and removing a section along a straight line (4, 14, 40, 40") extending at right angles to the symmetry axis (15), and the line of the second layer forming a rectilinear edge, and the two layers being conductively connected to one another, the conductive connection being made by point or strip connection elements (5, 19) on the border (8, 18) of the layers which is remote from the line (4, 14, 40, 40') or directly adjoining said border (8, 18), characterized in that diaphragms (10) are arranged parallel to the line (4, 14, 40, 40'), the diaphragms (10) being formed by holes in the second layer.

4. The planar antenna (1) as claimed in claim 3, wherein the shape of the first layer is selected from the group consisting of circular, elliptical, triangularly shaped, square or hexagonal.

5. The planar antenna (1) as claimed in claim 3 wherein the shape of the surface of each diaphragm (10) is selected from the group consisting of circular, elliptical, rectangular, square, triangular, hexagonal, or irregular.

6. The planar antenna (1) as claimed in claim 3, wherein the planar antenna (1) is excited by means of a coaxial waveguide, the inner conductor of the waveguide being conductively connected to the second layer and the outer conductor of the waveguide being conductively connected to the first layer, the inner conductor being arranged through a diaphragm (7, 17, 70, 70') within the first layer, axially symmetric to the diaphragm border and without electrical connection to the latter.

7. The planar antenna (1) as claimed in claim 3, wherein the conductive connection between the two conductive layers is made by means of continuous conductive materials (19) designed in two-dimensional strip form.

8. The planar antenna (1) as claimed in claim 3, wherein the layers are kept spaced apart by means of nonconductive elements (9).

9. The planar antenna (1) as claimed in claim 3, wherein there is a dielectric (11) between the two layers.

10. The planar antenna (1) as claimed in claim 3, wherein the planar antenna (1) consists of a dielectric support (11) that is planar and which is conductively coated and whose coatings form the conductive layers (12, 13).

11. The planar antenna (1) as claimed in 10, wherein the conductive connection between the two conductive layers is made by means of a continuous conductive coating along the contact length over the entire height of the dielectric support (11).

12. The planar antenna (1) as claimed in claim 3, wherein the borders (8, 18) of the two layers, which are conductively connected to one another in sections or at points, lie flush above one another.

13. The planar antenna (1) as claimed in claim 12, wherein the two layers' borders (8, 18) which are in part conductively connected to one another are/at least in portions straight and mirror-symmetric with respect to the symmetry axis (15).

14. The planar antenna (1) as claimed in claim 13, wherein the border (8, 18) of the dielectric support (11) extends in a straight line parallel to the border of the two conductive layers in the region of the conductive connection (5, 19), the borders (8, 18) each being at an angle $\phi$; said angle being measured between the line formed between the symmetry axis (15) and one of the borders (8, 18), said angle being greater than 0 degrees and less than 90 degrees.

15. The planar antenna (1) as claimed in claim 3, wherein the surface of the second layer is a segment portion or a subregion of the surface of the first layer.

16. The planar antenna (1) as claimed in claim 3, wherein the length of the perpendicular (20) to the straight line (4, 40, 40') of the second layer, measured between the straight line (4, 40, 40') and border (8, 18) remote from the straight line (4, 40, 40'), changes starting from the symmetry axis (15) in such a way that the planar antenna (1) can receive or transmit more than one frequency.

* * * * *